US006881080B2

(12) United States Patent
Macaluso

(10) Patent No.: US 6,881,080 B2
(45) Date of Patent: Apr. 19, 2005

(54) REMOVABLE MICROPHONE MOUNT AND METHOD

(75) Inventor: John Macaluso, Clifton, NJ (US)

(73) Assignee: FSR Inc., West Paterson, NJ (US)

( * ) Notice: Subject to any disclaimer, the term of this patent is extended or adjusted under 35 U.S.C. 154(b) by 47 days.

(21) Appl. No.: 10/625,095

(22) Filed: Jul. 22, 2003

(65) Prior Publication Data

US 2005/0020110 A1 Jan. 27, 2005

(51) Int. Cl.[7] ..... H01R 13/44
(52) U.S. Cl. ..... 439/142; 381/366
(58) Field of Search ..... 439/136, 142; 381/76, 381/82, 366, 361, 363, 368, 91

(56) References Cited

U.S. PATENT DOCUMENTS 3,573,401 A * 4/1971 Lininger ..... 381/363
3,684,831 A * 8/1972 Fullmer ..... 381/75
3,848,944 A * 11/1974 Gilmer, Jr. ..... 312/314
4,052,561 A * 10/1977 Molay ..... 381/75
4,166,926 A * 9/1979 Sieler ..... 381/75
4,955,578 A * 9/1990 Fidi ..... 248/559
5,115,470 A * 5/1992 Sutheim ..... 381/76
5,124,506 A * 6/1992 Briggs et al. ..... 174/67
5,571,023 A * 11/1996 Anthony ..... 439/142
5,926,554 A * 7/1999 Hasenmaier ..... 381/61
5,988,585 A * 11/1999 Eaton ..... 248/638
6,092,885 A * 7/2000 James ..... 312/233
6,162,071 A * 12/2000 Muller ..... 439/142
6,179,634 B1 * 1/2001 Hull et al. ..... 439/142
6,498,859 B1 * 12/2002 Kuerti et al. ..... 381/361
6,590,989 B1 * 7/2003 Chen ..... 381/363

* cited by examiner

*Primary Examiner*—Ross Gushi
(74) *Attorney, Agent, or Firm*—Hedman & Costigan, P.C.

(57) ABSTRACT

A mount for removably mounting a microphone having a plug connector to the surface of an article of furniture having an aperture therein, the mount comprising a receiver having a connector which mates with the plug connector of the microphone, the receiver having means for transmission of a signal, a bracket for holding the receiver within the area of the aperture, the bracket comprising acoustic isolators between the receiver and the bracket and a cover for covering the aperture on the surface of the article of furniture, the cover comprising hinge means for opening at least a portion of the cover corresponding to the receiver.

Also, a method of removably mounting a microphone includes the steps of first creating an aperture through the surface of an article of furniture to the underside of said surface, then attaching a bracket to underside of the surface, the bracket being adapted to hold a receiver in the area of the aperture. A cover is placed over the aperture in the surface of the article of furniture and the bracket is connected to the cover to retain the two items in a fixed relation.

13 Claims, 2 Drawing Sheets

REMOVABLE MICROPHONE MOUNT AND METHOD

FIELD OF THE INVENTION

The present invention relates to the field of removably mounted electronic microphones and a method of removably mounting an electronic microphone.

BACKGROUND OF THE INVENTION

Electronic microphones have long been used for public address in a variety of settings, including such settings as courtrooms, conference and boardroom tables, lecterns, state houses and pulpits, to name a few. Due to the requirements of wiring and that microphones were generally used in one place, many microphones were permanently mounted. However, as requirements changed, it became desirable to have microphones which could be removed when necessary, for convenience or for security reasons.

Removable microphones have taken various forms, including portable models which can be merely placed on a table or the like without any permanent fixture whatsoever. An alternative is a mount for a microphone that is permanently affixed to a lectern or the like, which has a C-shaped opening for receiving a tapered microphone handle. Still others include a fixture with a connection for receiving a microphone that has a corresponding connection which mates with the connection on the fixture.

When using a fixture with a corresponding connection for receiving a microphone, it is generally the practice to affix the fixture to the top of a table, lectern, bench, etc. In such cases, the fixture can be flush mounted on the surface of the object on which the microphone will sit. However, when the microphone is removed, the connection on the fixture is exposed until the microphone is reinserted into the connection of the fixture.

It is therefore an object of the present invention to provide a microphone mount for removably mounting a microphone on a table, desk, lectern or the like, said mount including means for concealing the fixture connection when the microphone is not mounted thereon. It is a further object of the present invention to provide such a mount which is adaptable to the object to which the mounting fixture is attached.

SUMMARY OF THE INVENTION

This and other objects are achieved by the present invention which is directed to a mount for removably mounting a microphone having a plug connector to the surface of an article of furniture having an aperture therein, said mount comprising a receiver having a connector which mates with the plug connector of the microphone, said receiver having means for transmission of a signal, a bracket for holding said receiver within the area of the aperture, said bracket comprising acoustic isolators between the receiver and the bracket and a cover for covering the aperture on the surface of the article of furniture, said cover comprising hinge means for opening at least a portion of the cover corresponding to the receiver.

The mount is preferably firmly affixed to the article of furniture and the cover is preferably likewise retained over the aperture on the surface of the article of furniture. These functions can be achieved in a number of ways, however, it is preferred that the cover includes a lip for seating on the aperture of the article of furniture. It is further preferred that the cover is retained on the bracket by a retention member passing between the bracket and the cover. With respect to the bracket, it is most preferred that the bracket is attached to the underside of the article of furniture in the area of the aperture.

Additionally, the invention includes a method of removably mounting a microphone to an article of furniture. The method includes the steps of first creating an aperture through the surface of an article of furniture to the underside of said surface, then attaching a bracket to underside of the surface, said bracket being adapted to hold a receiver in the area of the aperture. A cover is placed over the aperture in the surface of the article of furniture and the bracket is connected to the cover to retain the two items in a fixed relation.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

Figure 1:
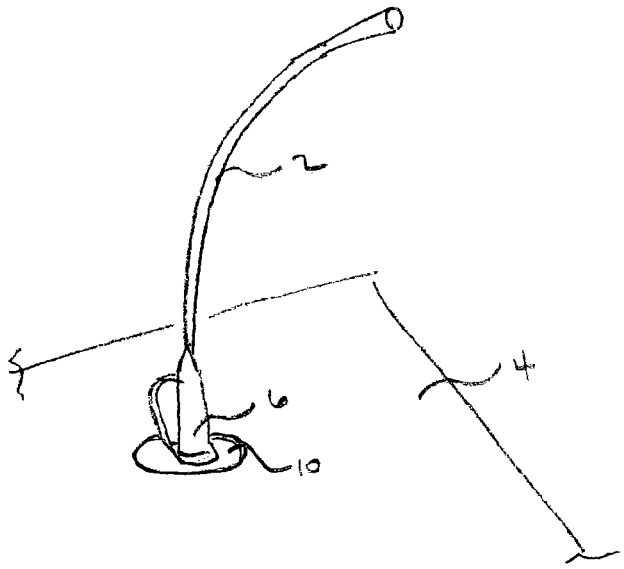
FIG. 1 is a perspective view of a microphone removably mounted in accordance with the present invention.

As shown in the drawings, and more particularly FIG. 1, the present invention is directed to a mount for removably mounting a microphone 2 on an article of furniture 4 such as a desk, table, lectern or the like having an aperture therein. The microphone 2 can be any suitable type having a connector 6 for releasable connection to a corresponding fixed connector 8 that is attached to an article of furniture 4. For the purposes hereof, a SHURE microphone with an XLR connector of 1 inch in diameter or less has been found to be the most preferred.

Figure 4:
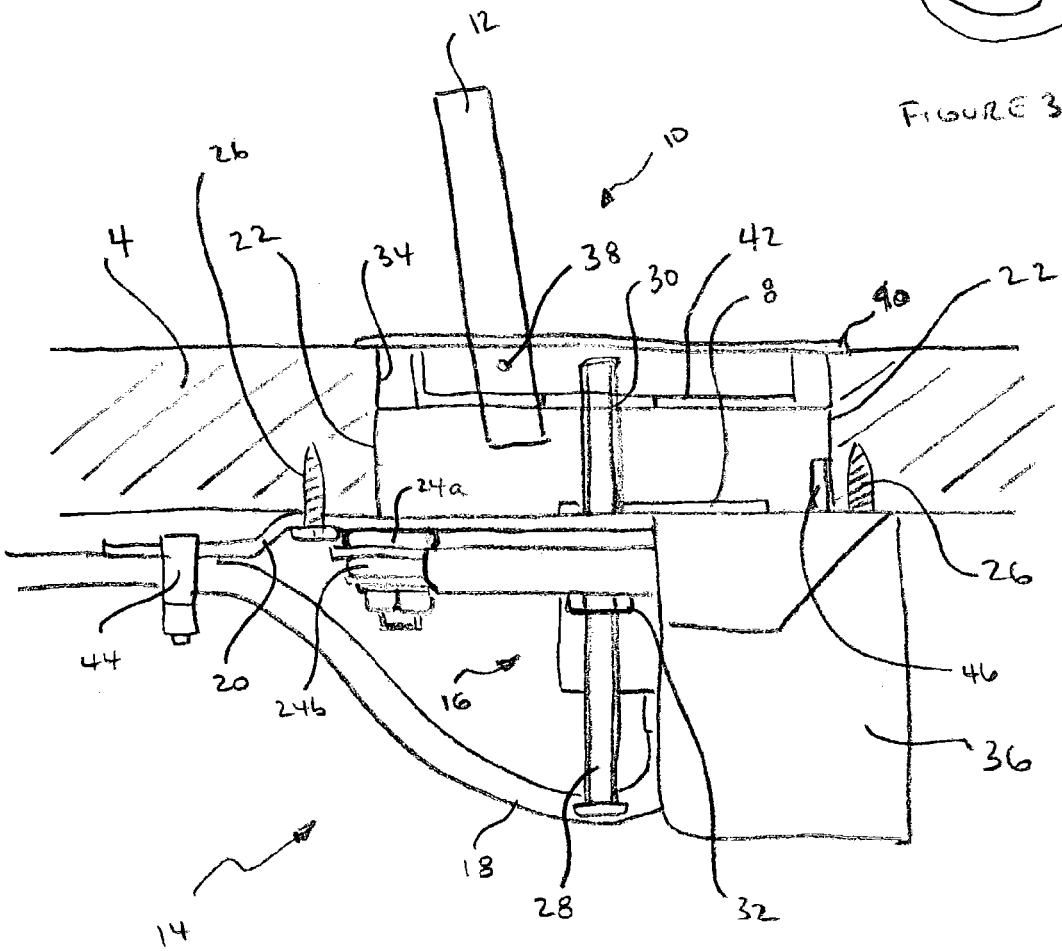
FIG. 4 is a partial cross sectional elevation of the mount of the present invention attached to an article of furniture.

As best shown in FIG. 4, the fixed XLR connector 8 is part of a mount 14 on the article of furniture 4 for removably mounting the microphone 2 having the XLR connector 6. For the purposes of this invention, a NEUTRIX XLR Model NC3FD-I-1-O connector is suitable.

The mount 14 comprises a receiver 16, which includes the connector 8 and means for transmission 18 of a signal from the connector 8 to audio components (not shown). A subplate bracket 20 is preferred for holding the receiver 16 within the area of the aperture 22 in the article of furniture 4. The bracket 20 preferably comprises acoustic isolators 24*a* and 24*b*, being any acoustic insulator and most preferably comprising 3 rubber bushings, between the receiver 16 and the bracket 20 elements. The bracket 20 also preferably includes one or more alignment tabs 46 to properly align the receiver within the aperture 22.

In its most preferred embodiment, the connector 8 of the mount 14 is movably fixed to the bracket 20 to allow vertical adjustment of the height of the connector 8 within the aperture 22. Thus, the connector can be moved closer or farther from the cover 10 to compensate for different articles of furniture 4 having different surface thickness. Any suitable means for vertical height adjustment can be used, as are well known in the art. For example, a threaded ring closure, which can be tightened around the connector 8 once the connector 8 is set at a desired vertical height, would be suitable for use in this invention.

The bracket 20 is preferably secured to the article of furniture 4. In the most preferred embodiment of FIG. 4 one or more attachment members 26, shown in the figure as screws, secure the bracket 20 to the article of furniture 4. Also most preferred is the use of one or more retention members 28 between the bracket 20 and the cover 10, which act to retain the cover 10 in fixed relation to the bracket 20 over the aperture 22 on the surface of the article of furniture 4.

Of course, the attachment members 26 can be any type, including such items as screws, snaps, rivets, spikes, nails, adhesive, or any suitable member that will maintain the bracket on the underside of the article of furniture 4. Of the suitable attachment members 26, screws have been found to be most preferred, especially when the bracket 20 is being attached to an article of furniture made of wood. Most preferably, four ½ inch screws are used to attach the bracket 20 to the underside of the surface of the article of furniture 4.

Additionally, the retention members 28 can be any type, including items such as bolts, clasps, leaders, or any suitable item that can maintain a retained relationship between the bracket 20 and the cover 10. In the most preferred embodiment, the retention members 28 are bolts which thread into receptacles 30 in the underside of the cover 10 and include back nuts 32 which can be tightened against the bracket 20 to ensure that the fixed relationship between the bracket 20 and cover 10 is retained.

In an alternative embodiment, the bracket 20 can be secured directly to the cover 10 with retention members 28, eliminating the need for attachment members, so that the retention members 28 create a snug fit of the bracket 20 and cover 10 across the surface of the article of furniture 4. In such an embodiment, there would not need to be an attachment member 26 between the bracket 20 and the article of furniture 4, wherein the friction fit would maintain the receiver 16 in relation to the aperture 22. In this alternative embodiment, it would be preferred to have a lip (not shown) on the bracket 20 and a lip 34 on the underside of the cover that would each fit within the aperture 22 to avoid lateral shifting of the mount 14 within the aperture 22.

In any event, the bracket 20 should be manufactured of a rigid material that can withstand forces consistent with the mounting of a microphone 2. Although many such materials may be used, it is preferred that the bracket 20 of the present invention be made of metal, with a steel plate of about ⅛ to 3⁄16 of an inch being most preferred. The bracket 20 preferably includes a strain relief member 44 for initially capturing a wire 18 used for transmission of the signal near the underside of the surface of the article of furniture 4 as it exits the connector 8, thus avoiding strain on the wire 18 and holding the wire 18 out of the way of a user. The strain relief member 44 can be any type, however, a tie wrap has been found to be suitable.

In its most preferred embodiment, a shroud 36 is placed over at least a portion of the receiver 16, including the bracket 20, for concealing the components from view. Any appropriate material can be used for the shroud 36, including plastic, metal, wood or the like. The shroud 36 can be attached directly to the underside of the article of furniture 4; can be attached directly to the bracket 20 or can be slipped over the edge of the bracket 20 during attachment during attachment of the bracket 20 to the article of furniture 4 for a clamp or friction fit.

Figure 2:
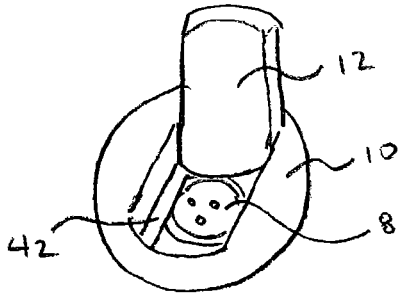
FIG. 2 is a perspective view of the mount of the present invention with the cover in its open configuration.
Figure 3:
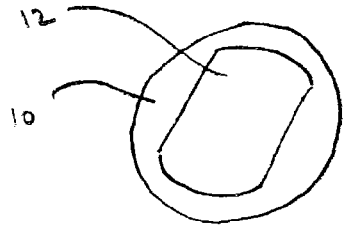
FIG. 3 is a perspective view of the mount of the present invention with the cover in its closed configuration.

Turning to FIGS. 2 and 3, the cover 10 of the present invention is shown in its open and closed configurations respectively. In its open configuration, shown in FIG. 2, the lid 12 of the cover 10 is opened about pivot 38 (see FIG. 4) to expose the fixed XLR connector 8 for receiving the microphone XLR connector 6. In its closed configuration, shown in FIG. 3, the lid 12 of the cover 10 is pivoted to conceal the fixed XLR connector 8 on the surface of the article of furniture.

In its preferred embodiment, the cover 10 is milled from a solid piece of material. Any suitable materials can be used, with milled aluminum, brass, copper, steel and titanium being most preferred. The cover 10 is manufactured to fit securely within the aperture 22, through the use of a lip 34 having a diameter substantially equal to the diameter of the aperture 22 to avoid lateral shifting of the cover 10 on the surface of the article of furniture 4. An upper edge 40 of the cover 10, preferably having a rounded end for smooth transition to the surface of the article of furniture 4, is designed to rest on the surface of the article of furniture 4.

The cover 4 also preferably includes at least one stop member 42, which stops the travel of the lid 12 as it is moved into its closed configuration at the point where the closed lid 12 rests flush with the surface of the cover 10. When an aperture 22 in the surface of the article of furniture 4 of about 2 inches is used, the cover 10 would preferably have an inner diameter of about 1.975 inches and an outer diameter of about 2.175 inches, with a thickness of about 0.312 inches.

The present invention can be mounted in a number of ways, as long as the connector 8 is sufficiently secured in relation to the article of furniture 4 to allow a microphone to be releasably mounted. Preferably, the article of furniture 4 to which the present invention is to be mounted has a surface thickness of about ⅝ to about 2⅛ inches thick with about 1½ inches of under surface clearance.

In its most preferred embodiment, the mount 14 is installed by creating an aperture through the surface of an article of furniture 4 to the underside of said surface, attaching the bracket 20 to underside of the surface, placing the cover over the aperture in the surface of the article of furniture and connecting the cover to the bracket. Alignment tabs 46 are used on the bracket 20 to properly align the bracket within the aperture 22 prior to attachment of the bracket 20 to the underside of the surface.

The bracket 20 is attached to the underside of the surface of a wood or composite article of furniture 4 by screwing in four (4) ½ inch screws. Once the cover 10 is placed on the top surface of the article of furniture, two (2) retention bolts 28 are screwed into threaded receptacles 30 in the bottom of the cover 10. Back nuts 32 are tightened on the retention bolts 28 against the bracket 20 for a secure fit of the cover 10 to the article of furniture 4. The wire 18 from the connector 8 is secured to the bracket 20 for strain relief by a tie-wrap 44.

The aperture 22 can be any size, however, it has been found that 2 inches is an appropriate size, small enough to not be intrusive while large enough to accommodate a 1 inch XLR connector 8. Of course, the lip 34 of the cover 10 would be substantially the same diameter as the aperture, to provide a snug fit thereby avoiding lateral movement of the cover in the aperture, as described above.

Variations, modifications and alterations to the preferred embodiment of the present invention described above will make themselves apparent to those skilled in the art. All such changes are intended to fall within the spirit and scope of the present invention, limited solely by the appended claims.

I claim:

1. A mount for removably mounting a microphone having a plug connector to the surface of an article of furniture having an aperture therein, said mount comprising:

a. a receiver having a connector which mates with the plug connector of the microphone, said receiver having means for transmission of a signal;

b. a bracket for holding said receiver within the area of the aperture, said bracket comprising acoustic isolators between the receiver and the bracket; and c. a cover for covering the aperture on the surface of the article of furniture, said cover comprising hinge means for opening at least a portion of the cover corresponding to the receiver.

2. The mount of claim 1 further comprising at least one attachment member for semi-permanent attachment of the bracket to the underside of the surface of the article of furniture.

3. The mount of claim 2 wherein the at least one attachment member is a screw for passing through a hole in the bracket and screwing into the underside of the piece of furniture.

4. The mount of claim 1 further comprising at least one retention member for retaining the cover on the surface of the article of furniture.

5. The mount of claim 4 wherein the at least one retention member comprises a bolt which extends from the bracket to the cover for a fixed relationship between the bracket and the cover.

6. The mount of claim 1 wherein the cover is milled from a single piece of metal.

7. The mount of claim 6 wherein the metal is taken from the group consisting of aluminum, brass, copper, steel and titanium.

8. The mount of claim 1 further comprising a shroud for at least partial enclosure of the bracket and receiver on the underside of the article of furniture.

9. The mount of claim 1 wherein said bracket comprises means for adjustment of the height of the connector relative to the surface of the article of furniture.

10. A method of mounting a microphone comprising the steps of:

a. creating an aperture through the surface of an article of furniture to the underside of said surface;

b. attaching a bracket to underside of the surface, said bracket being adapted to hold a receiver in the area of the aperture;

c. placing a cover over the aperture in the surface of the article of furniture;

d. connecting the cover to the bracket.

11. The method of claim 10 wherein the aperture is about 2 inches in diameter.

12. The method of claim 10 wherein the bracket is attached to the underside of the surface of the article of furniture by screwing a screw through a hole in the bracket and into the underside of the surface of the article of furniture.

13. The method of claim 10 wherein the cover is connected to the bracket by a bolt which engages the bracket and the cover.

* * * * *